US007380701B2

(12) United States Patent
Fogle et al.

(10) Patent No.: US 7,380,701 B2
(45) **Date of Patent: *Jun. 3, 2008**

(54) CARTON FOR BRICK-SHAPED CONTAINERS WITH A TOP DISPENSER

(75) Inventors: James C. Fogle, Marietta, GA (US); Raymond R. Spivey, Sr., Mableton, GA (US); Jean-Manuel Gomes, Marietta, GA (US); Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 105 days.

This patent is subject to a terminal disclaimer.

(21) Appl. No.: 11/189,611

(22) Filed: Jul. 26, 2005

(65) Prior Publication Data

US 2005/0279815 A1 Dec. 22, 2005

Related U.S. Application Data

(63) Continuation of application No. 10/437,121, filed on May 13, 2003, now Pat. No. 6,981,631.

(51) Int. Cl.
*B65D 5/54* (2006.01)
*B65D 17/28* (2006.01)

(52) U.S. Cl. ..... 229/103.2; 206/431

(58) Field of Classification Search ..... None
See application file for complete search history.

(56) References Cited

U.S. PATENT DOCUMENTS

| | | | | |
|---|---|---|---|---|
| 2,383,183 A | | 8/1945 | Fischer | |
| 2,594,376 A | | 4/1952 | Arneson | |
| 3,167,214 A | | 1/1965 | Mahon | |
| 3,313,406 A | * | 4/1967 | Outwater | 206/431 |
| 3,747,835 A | | 7/1973 | Graser | |
| 4,032,053 A | | 6/1977 | Wilson | |
| 4,034,852 A | | 7/1977 | Forrer | |
| 4,202,446 A | * | 5/1980 | Sutherland | 206/427 |
| 4,382,505 A | | 5/1983 | Sutherland et al. | |
| 4,415,082 A | * | 11/1983 | Martin | 229/240 |
| 4,424,901 A | | 1/1984 | Lanier | |
| 4,440,340 A | * | 4/1984 | Bakx | 206/427 |
| 4,566,593 A | | 1/1986 | Muller | |
| 4,582,199 A | * | 4/1986 | Schuster | 206/427 |
| 4,925,019 A | | 5/1990 | Ganz et al. | |
| 5,060,804 A | | 10/1991 | Beales et al. | |
| 5,390,784 A | | 2/1995 | Sutherland | |
| 5,605,228 A | | 2/1997 | Baxter | |
| 5,609,251 A | | 3/1997 | Harris | |
| 6,502,743 B2 | | 1/2003 | Ikeda | |
| 6,981,631 B2 | * | 1/2006 | Fogle et al. | 229/103.2 |

* cited by examiner

*Primary Examiner*—Gary E Elkins
(74) *Attorney, Agent, or Firm*—Womble carlyle Sandridge & Rice, PLLC

(57) ABSTRACT

A carton is provided for containing brick-shaped containers which has a dispenser in the top permitting the removal of any of the containers while maintaining the structural integrity of the carton through the provision of either a top gusset or middle gusset spanning each end of the carton. The top of the carton serves as a dispenser when the dispenser flap is removed.

24 Claims, 4 Drawing Sheets

CARTON FOR BRICK-SHAPED CONTAINERS WITH A TOP DISPENSER

CROSS-REFERENCE TO RELATED APPLICATION

This application is a continuation of U.S. patent application Ser. No. 10/437,121 filed May 13, 2003 now U.S. Pat. No. 6,981,631, which is hereby incorporated herein by reference in its entirety.

FIELD OF THE INVENTION

This invention relates generally to cartons for brick-shaped containers, such as Tetra Pak®, that has a dispenser in the top for the removal of the containers, but permits the carton to remain intact as a package.

BACKGROUND OF THE INVENTION

Brick-shaped containers made of paperboard and plastic composites for containing drinks have become popular in recent years. One of the popular brands of such containers is Tetra Pak®. These brick-shaped containers with product are sometimes sold as a single package. A number of these containers can be packaged together in plastic wrap. The plastic wrap is destroyed when the package is opened. Paperboard cartons can be used for containing these brick-shaped containers, but they are also destroyed as a package when they are opened to remove one or more containers. It would be desirable to have a package that could be torn open to allow the removal of one or more containers, but would still function as a package for the containers that are not removed.

SUMMARY OF THE INVENTION

It is an object of the present invention to provide a dispenser for a carton for containing brick-shaped containers to allow the removal of one or more containers without destroying the utility of the carton containing the unremoved containers.

The objects of this invention are achieved by providing a carton for the dispenser that can be torn from the top panel and which has gussets at the top or middle of the carton for holding the two side panels together when the dispenser is torn open. This carton permits the removal of one or more containers, but it will still function as a carton for containing the unremoved containers. The top or middle gusset holds the side panels of the carton together forming a secure package even after the removal of the top dispenser flap. The top gusset is simply attached by fold lines to the two side panels by a side gusset on each side. The middle gusset is attached by a tuck-in gusset which is attached to a side gusset which in turn is attached to the middle of each side panel. This permits the middle gusset to span the end wall of the carton near its middle.

The carton of this invention can be held together either by locks or glue on the bottom flaps.

DETAILED DESCRIPTION OF THE PREFERRED EMBODIMENTS

The present invention is intended primarily for use with brick-shaped packages, such as Tetra Pak®, that contain various types of drinks. The brick-shaped containers are constructed of a composite of paperboard and plastic and designed to have a long shelf life without refrigeration.

Figure 1:
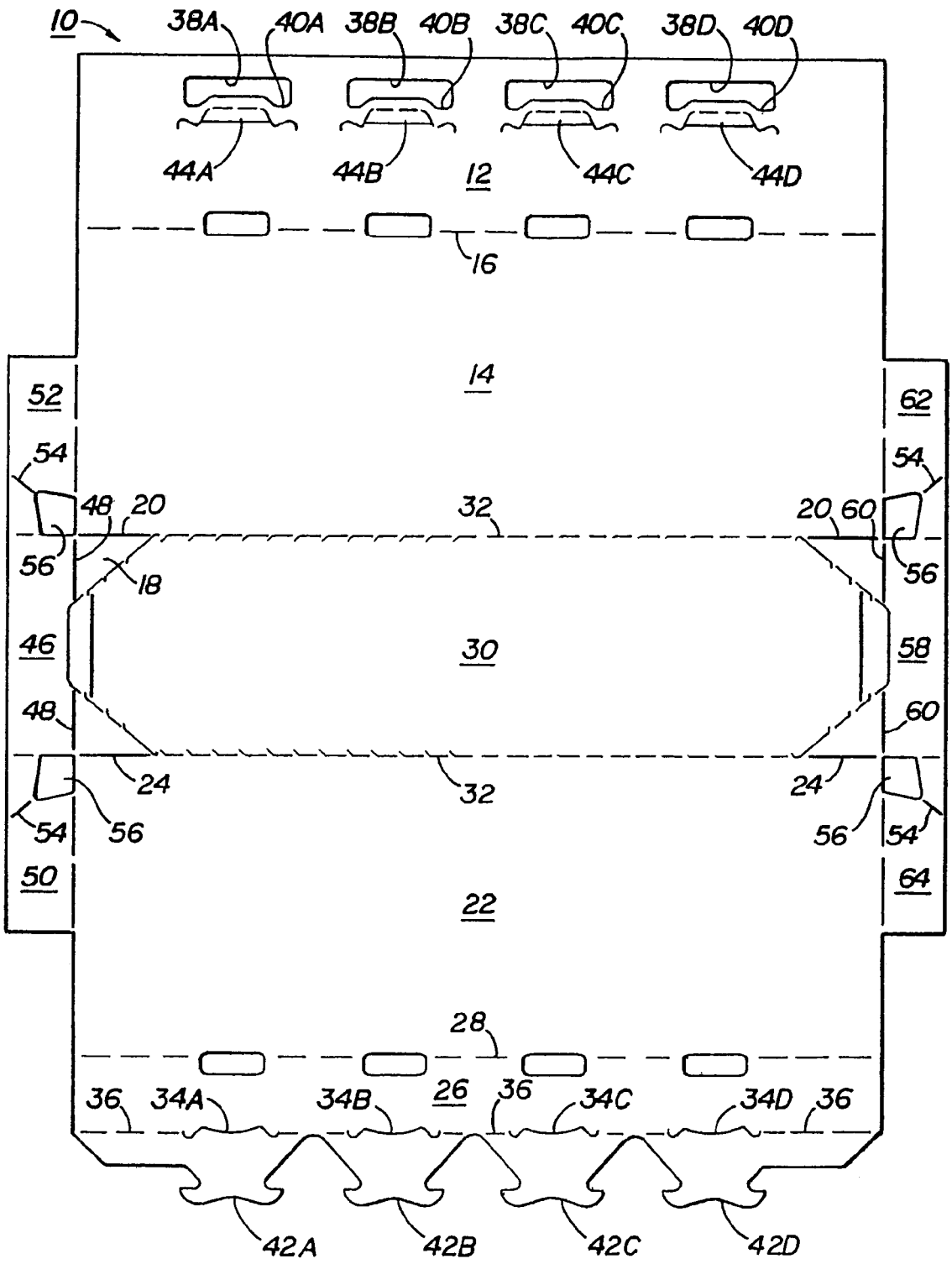
FIG. 1 is a plan view of the blank for containing brick-shaped containers that has a dispenser in the top and: a top gusset that spans each end of the carton connecting the side panels together.

The blank for forming the carton of this invention is illustrated in FIG. 1. This blank 10 is designed to contain ten brick-shaped containers C in two rows of five each. The blank 10 is formed from a foldable sheet of material, such as paperboard. The blank 10 has a bottom flap 12, which is foldably connected to side panel 14 by fold line 16 and in turn connected to top panel 18 by fold line 20. Top panel 18 is connected to side panel 22 by fold line 24, which in turn is connected to bottom flap 26 by fold line 28. A dispenser flap 30 occupies nearly all of the top panel 18. The dispenser flap 30 can be torn from the carton along tear line 32 to form a dispenser in the top of the carton.

It should be understood that bottom flaps 12 and 26 can be glued together. However, in this embodiment, a locking system is used which includes both a primary locking system and a secondary locking system. The primary locking system is a locking arrangement between primary male locks 34A-D formed along fold line 36 in bottom flap 26 and primary female openings 38A-D in bottom flap 12. The primary male locks 34A-D are hooked over primary female ledges 40A-D in the locking of the carton. As it is important to tighten the carton tightly about the containers, primary female openings 38A-D also serve as tightening apertures, which allow mechanical tightening fingers to enter and tighten the carton during forming.

The primary locks connect the ends of the carton together via the flaps, while the secondary locks function to main the engaged flaps in place in order to provide a "backup" locking system to prevent the primary locks from separating.

The secondary locking system consists of secondary male locks 42A-D formed as an extension of bottom flap 26. Secondary female openings 44A-D secure the secondary male locks 42A-D when they are inserted into the respective secondary female openings 44A-D.

It will be noticed that each pair of primary and secondary locks are aligned longitudinally, i.e., the length of the blank. This carton provides a locking system that is more secure because there are both primary and secondary locks. While the primary locks connect the ends of the carton together, the secondary locks keep the primary locks engaged.

The carton of this invention has a top gusset 46 that spans one end of the carton. Top gusset 46 is connected to top panel 18 by fold line 48 and is connected to side gusset 50 by fold line 24 and side gusset 52 by fold line 20. Side gussets 50 and 52 serve to hold the top gusset 46 in proper position across the top end of the carton. Fold line 54 may be provided in each side gusset 50 and 52 to facilitate folding the gussets into proper position. Apertures 56 may be provided to facilitate folding. The other end of the carton likewise has a top gusset 58 connected to top panel 18 by fold line 60. Top gusset 58 is connected to side gusset 62 and 64 by fold lines 20 and 24 respectively.

The carton of this invention is formed from the blank of FIG. 1 by moving the top panel along with the dispensing flap 30 over the containers C. The blank 10 can is pulled tight about the containers C and bottom flap 12 and bottom flap 26 are overlapped with bottom flap 26 being on the outside. Primary male locks 34A-D are punched inwardly into primary female openings 38A-D and are locked on primary female ledges 40A-D. The secondary male locks 42A-D are pushed inwardly into secondary female openings 44A-D.

In the process of folding side panels 14 and 22 downwardly, side gussets 50, 52, 62 and 64 are folded inwardly along with top gussets 46 and 58 so that the top gusset 46 and 58 span the end of a carton between the side panels 14 and 12 at the top.

Figure 2:
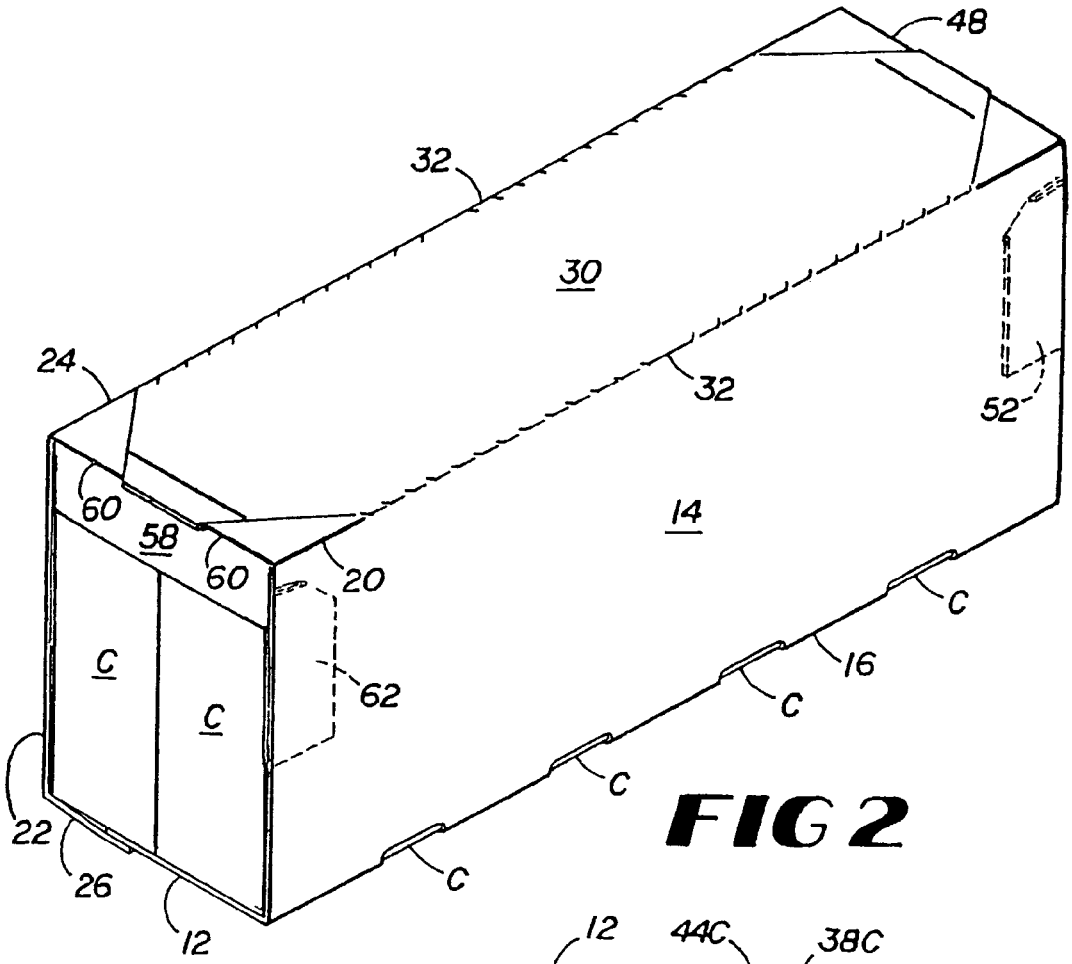
FIG. 2 is a perspective view of a carton drawn from the blank of FIG. 1 and loaded with containers.
Figure 6:
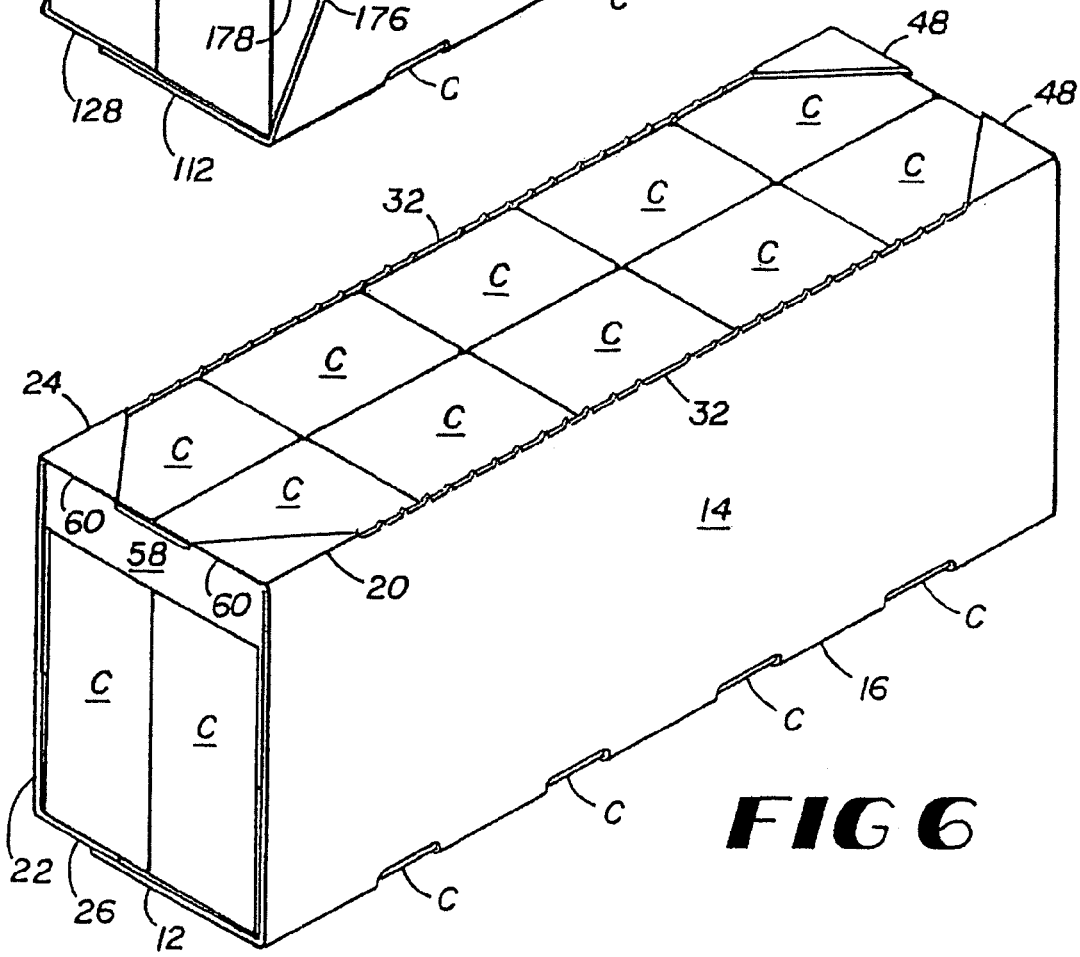
FIG. 6 is a perspective view of the top of the carton of FIG. 2 in which the dispenser top has been removed.

The carton loaded with containers is illustrated in FIG. 2. This carton can be opened by tearing tear line 32 and removing dispenser flap 30. The opened carton with containers C is illustrated in FIG. 6. Even though nearly the entire top panel 18 is removed, the carton is held together by the top gussets 46 and 58 and side gussets 50, 52, 62 and 64 at each end of the carton, thus providing a package for the containers that are not removed.

Figure 3:
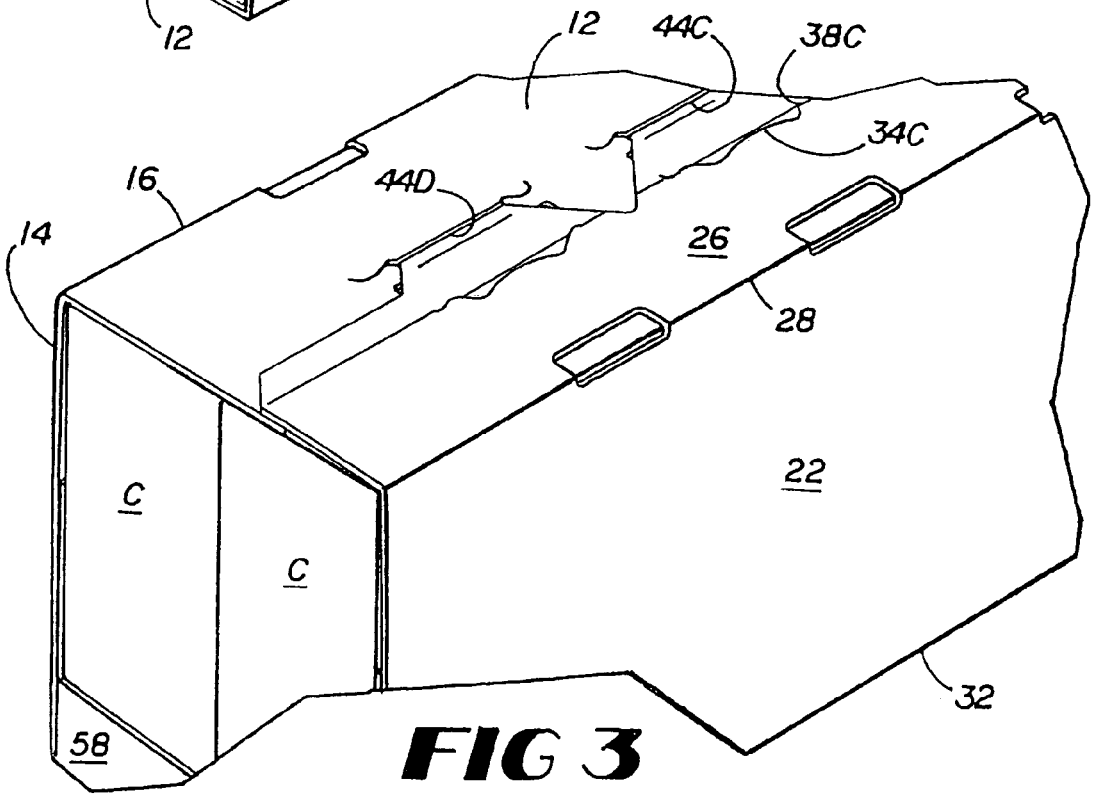
FIG. 3 is a perspective view of the bottom of the carton of FIG. 2 that has been formed from the blank of FIG. 1 and locked.

The primary and secondary locking systems of the present embodiment are illustrated in FIG. 3, which shows the bottom of the carton locked.

Figure 4:
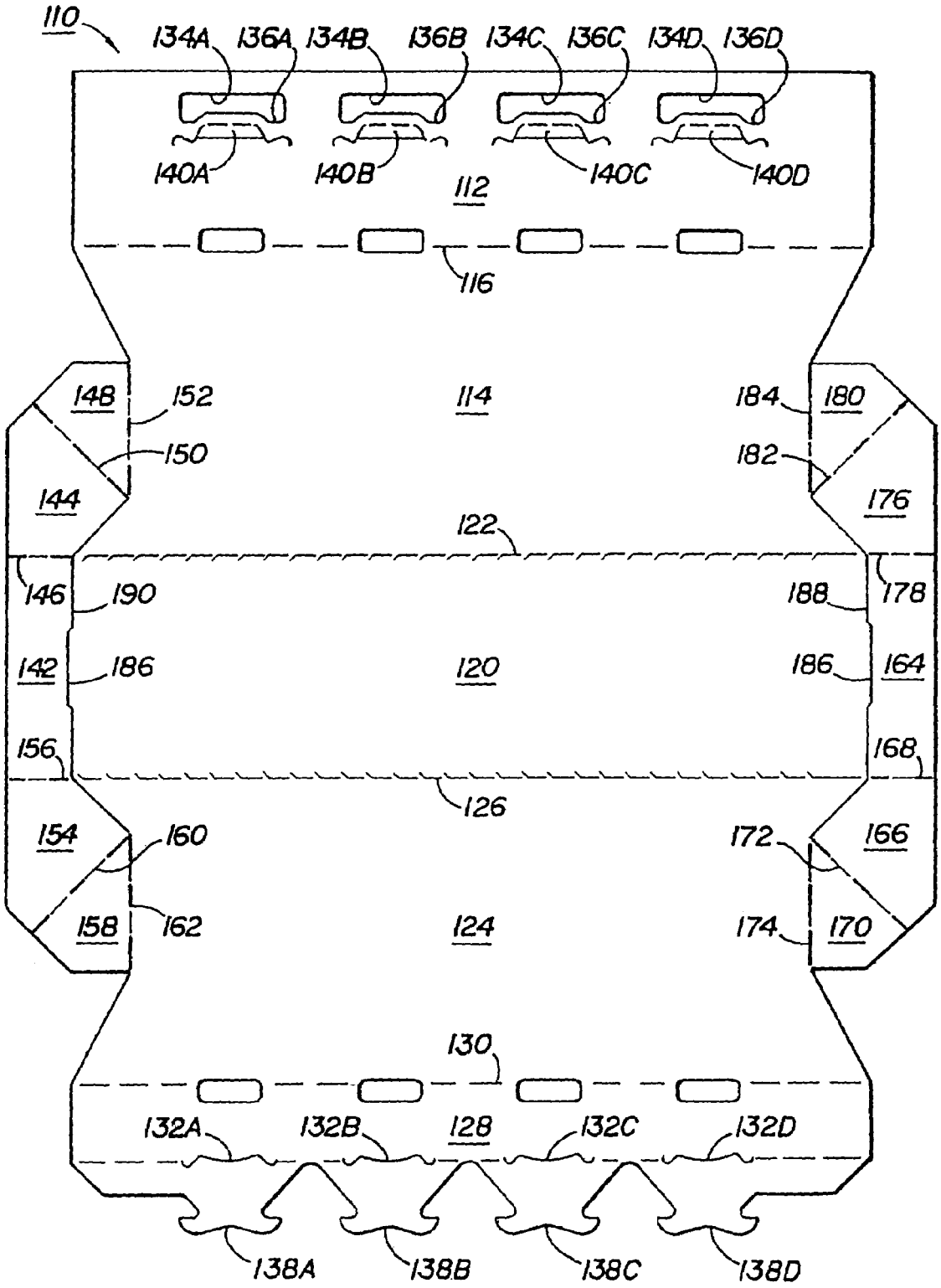
FIG. 4 is a plan view of the blank for forming a carton for containing brick-shaped containers that has a dispenser in the top and a gusset in the middle of each end of the carton for holding the side panels together.

The blank for forming of a carton with the middle gusset is illustrated in FIG. 4. This blank 110 has a bottom flap 112 that is connected to side panel 114 by fold line 116, which is connected to dispenser flap 120 which encompasses the entire top along tear line 122, which in turn is connected opposite side panel 124 by tear line 126. Side panel 124 is connected to bottom flap 128 by fold line 130. This carton has the same locking systems as illustrated in FIG. 1. It has a primary locking system with primary male locks 132A-D formed in bottom flap 128 and primary female openings 134A-D formed in bottom flap 112. Secondary male locks 138A-D are an extension of bottom flap 128 and are locked into secondary female openings 140A-D in bottom flap 112. These locks function in the same way as the locks described in connection with FIG. 1.

The blank 110 illustrated in FIG. 4 has a middle gusset 142 on one end of the carton that is foldably attached to tuck-in gusset 144 by fold line 146, which in turn is connected to side gusset 148 by fold line 150 which in turn is connected to side panel 114 by fold line 152. Middle gusset 142 is connected to tuck-in gusset 154 by fold line 156, which in turn is connected to side gusset 158 by fold line 160 which in turn is connected to side panel 124 by fold line 162. The other end of the carton has a middle gusset 164 which is connected to tuck-in gusset 166 by fold line 168 which in turn is connected to side gusset 170 by fold line 172 which in turn is connected to side panel 124 by fold line 174. Middle gusset 164 is connected to tuck-in gusset 176 by fold line 178 which in turn is connected to side gusset 180 by fold line 182 and in turn connected to side panel 114 by fold line 184. Dispenser flap 120 can be removed by pulling on either tear tab 186 on each end of the carton. The middle gussets 142 and 164 are separated from dispenser flap 120 by cut lines 190 and 188, respectively.

Figure 5:
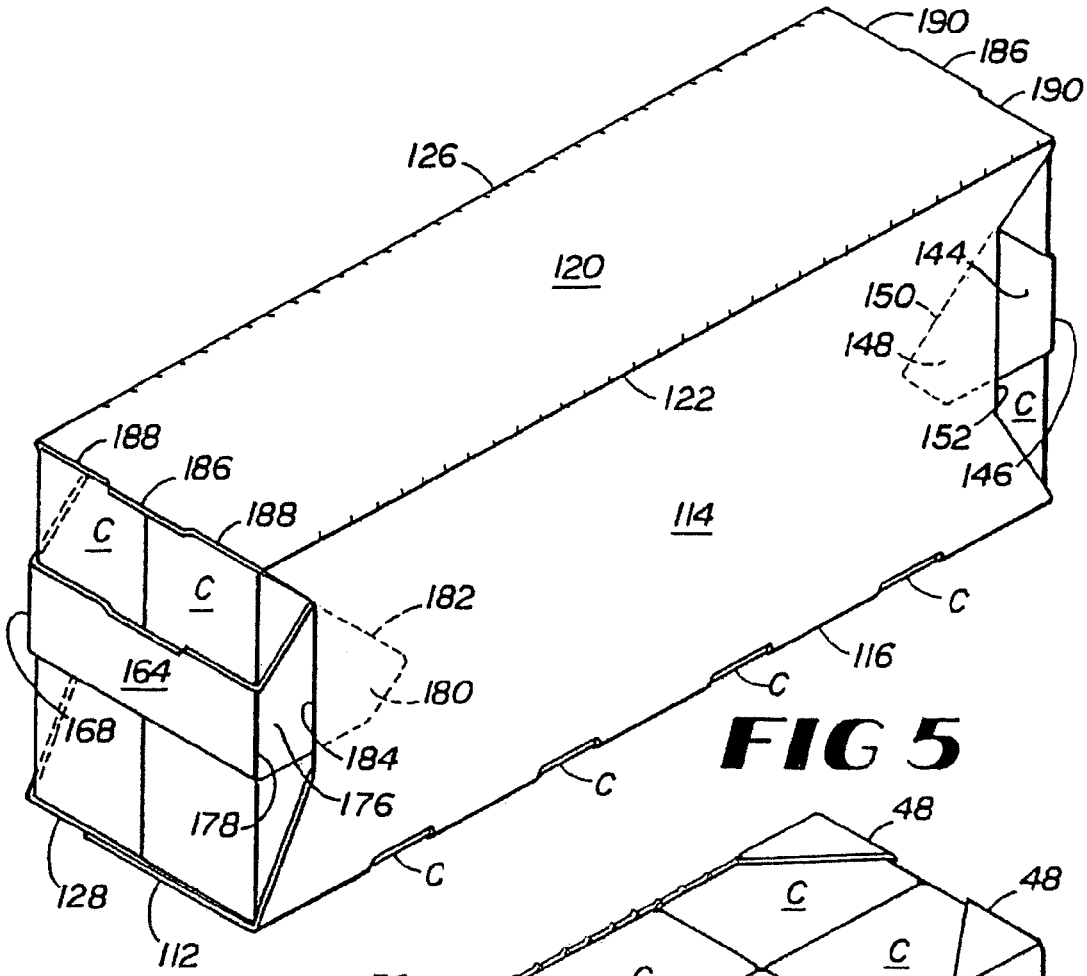
FIG. 5 is a perspective view of the carton formed from the blank of FIG. 4 and loaded with containers.

This carton is formed about containers and locked in the same way as the carton is formed from the blank shown in FIG. 1. A carton formed from the blank illustrated in FIG. 4 is shown in FIG. 5.

However, the middle gussets 142 and 164 of this embodiment span the end of the carton near its center. Tuck-in gussets 144, 154, 166, 176 and side gussets 148, 158, 170 and 180 are folded inwardly in the process of erecting this carton so that they rest between the inside of the side panels 124 and 114 and the containers therein. This results in holding middle gussets 142 and 164 tightly against the ends of the carton and prevents the containers from falling out when the dispensing flap 120 has been removed.

While the invention has been disclosed in its preferred forms, it will be apparent to those skilled in the art that many modifications, additions, and deletions can be made therein without departing from the spirit and scope of the invention and its equivalents as set forth in the following claims.

UNIQUE FEATURES OF THIS INVENTION

An important unique feature of this invention is that this carton provides a dispenser with easy access to all the containers contained in the carton, but preserves the integrity of the carton in holding containers through the provision of either a top gusset or middle gusset across each end of the carton which holds the containers in place in the carton and holds the carton together.

We claim:

1. A carton blank, comprising:

a top panel;

a first side panel foldably connected to the top panel at a first fold line;

a second side panel foldably connected to the top panel at a second fold line;

at least one bottom flap foldably connected to at least one of the first and second side panels;

a first top gusset foldably connected to a first side of the top panel;

a second top gusset foldably connected to a second side of the top panel;

at least one tear line defining a dispenser flap in the top panel, wherein the at least one tear line extends along the first fold line and along the second fold line adjacent to the first top gusset and adjacent to the second top gusset;

a first side gusset foldably connected to a first side of the first side panel;

a second side gusset foldably connected to a first side of the second side panel;

a third side gusset foldably connected to a second side of the first side panel;

a fourth side gusset foldably connected to a second side of the second side panel;

a first aperture disposed entirely within the first side gusset;

a second aperture disposed entirely within the second side gusset;

a third aperture disposed entirely within the third side gusset; and a fourth aperture disposed entirely within the fourth side gusset;

wherein the dispenser flap extends into the first top gusset to create a first tear tab and extends into the second top gusset to create a second tear tab;

wherein the dispenser flap is removable from the blank along the tear line;

wherein removal of the dispenser flap removes both the first tear tab and the second tear tab from the blank while leaving a portion of the first top gusset and second top gusset.

2. The blank of claim 1, wherein:

the first side gusset is foldably connected to the first top gusset along a fold line that is at least substantially collinear with the first fold line; and the second side gusset is foldably connected to the first top gusset along a fold line that is at least substantially collinear with the second fold line.

3. The blank of claim 1, wherein the at least one bottom flap comprises:

a first bottom flap foldably connected to the first side panel; and a second bottom flap foldably connected to the second side panel.

4. The blank of claim 3, further comprising:

a female locking member on the first bottom flap; and a male locking member on the second bottom flap.

5. The blank of claim 1, wherein the first and second top gussets are rectangular.

6. The blank of claim 1, wherein the dispenser flap extends across the entire top panel.

7. In combination, a parallelepipedal carton formed from the blank of claim 1, and a plurality of parallelepipedal containers within the carton.

8. A carton blank, comprising:

a top panel;

a first side panel foldably connected to the top panel at a first fold line;

a second side panel foldably connected to the top panel at a second fold line;

a first bottom flap foldably connected to the first side panel;

a second bottom flap foldably connected to the second side panel;

a first top gusset foldably connected to a first side of the top panel;

a first side gusset foldably connected to a first side of the first side panel and foldably connected to the top gusset along a fold line that is at least substantially collinear with the first fold line;

a second side gusset foldably connected to a first side of the second side panel;

a second top gusset foldably connected to a second side of the top panel;

a third side gusset foldably connected to a second side of the first side panel;

a fourth side gusset foldably connected to a second side of the second side panel;

a first aperture disposed entirely within the first side gusset;

a second aperture disposed entirely within the second side gusset;

a third aperture disposed entirely within the third side gusset;

a fourth aperture disposed entirely within the fourth side gusset; and at least one tear line defining a dispenser flap in the top panel, wherein the at least one tear line extends along the first fold line;

wherein the dispenser flap extends into the first top gusset to create a first tear tab and extends into the second top gusset to create a second tear tab;

wherein the dispenser flap is removable from the blank along the tear line;

wherein removal of the dispenser flap removes both the first tear tab and the second tear tab from the blank while leaving a portion of the first top gusset and second top gusset.

9. The blank of claim 8, wherein the at least one tear line extends along the second fold line.

10. The blank of claim 8, wherein the third side gusset is foldably connected to the second top gusset along a fold line that is at least substantially collinear with the first fold line.

11. The blank of claim 10, wherein:

the second side gusset is foldably connected to the first top gusset along a fold line that is at least substantially collinear with the second fold line; and the fourth side gusset is foldably connected to the second top gusset along a fold line that is at least substantially collinear with the second fold line.

12. The blank of claim 8, further comprising:

a female locking member on the first bottom flap; and a male locking member on the second bottom flap.

13. The blank of claim 8, wherein the dispenser flap extends across the entire top panel.

14. A carton blank, comprising:

a top panel;

a first side panel foldably connected to the top panel at a first fold line;

a second side panel foldably connected to the top panel at a second fold line;

a first bottom flap foldably connected to the first side panel;

a second bottom flap foldably connected to the second side panel;

a generally rectangular first top gusset foldably connected to a first side of the top panel;

a generally rectangular first side gusset foldably connected to a first side of the first side panel and foldably connected to the first top gusset along a fold line that is at least substantially collinear with the first fold line;

a generally rectangular second side gusset foldably connected to a first side of the second side panel and to the first top gusset;

a generally rectangular second top gusset foldably connected to the top panel;

a generally rectangular third side gusset foldably connected to a second side of the first side panel and to the second top gusset;

a generally rectangular fourth side gusset foldably connected to a second side of the second side panel and to the second top gusset;

a first aperture disposed entirely within the first side gusset;

a second aperture disposed entirely within the second side gusset;

a third aperture disposed entirely within the third side gusset;

a fourth aperture disposed entirely within the fourth side gusset;

at least one tear line defining a dispenser flap in the top panel; and means for locking the first bottom flap to the second bottom flap;

wherein the dispenser flap extends into the first top gusset to create a first tear tab and extends into the second top gusset to create a second tear tab;

wherein the dispenser flap is removable from the blank along the tear line;

wherein removal of the dispenser flap removes both the first tear tab and the second tear tab from the blank while leaving a portion of the first top gusset and second top gusset.

15. The blank of claim 14, wherein:

the third side gusset is foldably connected to the second top gusset along a fold line that is at least substantially collinear with the first fold line;

the second side gusset is foldably connected to the first top gusset along a fold line that is at least substantially collinear with the second fold line; and the fourth side gusset is foldably connected to the second top gusset along a fold line that is at least substantially collinear with the second fold line.

16. A carton blank, comprising:

a dispenser flap which forms an entire top panel of the blank, the dispenser flap being defined by at least one tear line;

a first side panel foldably connected to the top panel at a first fold line;

a second side panel foldably connected to the top panel at a second fold line;

at least one bottom flap foldably connected to at least one of the first and second side panels;

a first middle gusset adjacent to a first side of the top panel;

a second middle gusset adjacent to a second side of the top panel;

a first tuck-in gusset adjacent to a first side of the first side panel and foldably connected to the first middle gusset;

a first side gusset foldably connected to the first side of the first side panel and to the first tuck-in gusset, wherein the first side gusset is connected to the first side panel along a fold line that is not collinear with a cut line between the first tuck-in gusset and the first side panel;

a second tuck-in gusset adjacent to a first side of the second side panel and foldably connected to the first middle gusset; and a second side gusset foldably connected to the first side of the second side panel and to the second tuck-in gusset;

wherein the dispenser flap extends into the first top gusset to create a first tear tab and extends into the second top gusset to create a second tear tab;

wherein the dispenser flap is removable from the blank along the tear line; wherein removal of the dispenser flap removes both the first tear tab and the second tear tab from the blank while leaving a portion of the first top gusset and second top gusset.

17. The blank of claim 16, wherein the second side gusset is connected to the second side panel along a fold line that is not collinear with a cut line between the second tuck-in gusset and the second side panel.

18. The blank of claim 16, wherein the at least one tear line extends along the first fold line and along the second fold line.

19. The blank of claim 16, further comprising:

a third tuck-in gusset adjacent to a second side of the first side panel and foldably connected to the second middle gusset;

a third side gusset foldably connected to the second side of the first side panel and to the third tuck-in gusset, wherein the third side gusset is connected to the first side panel along a fold line that is not collinear with a cut line between the third tuck-in gusset and the first side panel;

a fourth tuck-in gusset foldably adjacent to a second side of the second side panel and foldably connected to the second middle gusset; and a fourth side gusset foldably connected to the second side of the second side panel and to the fourth tuck-in gusset.

20. The blank of claim 16, wherein the at least one bottom flap comprises:

a first bottom flap foldably connected to the first side panel; and a second bottom flap foldably connected to the second side panel.

21. The blank of claim 20, further comprising:

a female locking member on the first bottom flap; and a male locking member on the second bottom flap.

22. The blank of claim 16, wherein:

the first tuck-in gusset is foldably connected to the first middle gusset along a fold line that is at least substantially collinear with the first fold line; and the second tuck-in gusset is foldably connected to the first middle gusset along a fold line that is at least substantially collinear with the second fold line.

23. A carton blank, comprising:

a top panel;

a first side panel foldably connected to the top panel at a first fold line;

a second side panel foldably connected to the top panel at a second fold line;

at least one bottom flap foldably connected to at least one of the first and second side panels;

a first top gusset foldably connected to a first side of the top panel;

a second top gusset foldably connected to a second side of the top panel;

a dispenser flap in the top panel, wherein the dispenser flap is formed by at least one tear line, wherein the at least one tear line at least partially forms the first fold line and the second fold line, and wherein the at least one tear line extends adjacent to the first top gusset and adjacent to the second top gusset;

a first side gusset foldably connected to a first side of the first side panel;

a second side gusset foldably connected to a first side of the second side panel;

a third side gusset foldably connected to a second side of the first side panel; and a fourth side gusset foldably connected to a second side of the second side panel;

wherein the first side panel and the second side panel are configured to be folded perpendicularly to the top panel in an erected carton;

wherein the dispenser flap extends into the first top gusset to create a first tear tab and extends into the second top gusset to create a second tear tab;

wherein the dispenser flap is removable from the blank along the tear line;

wherein removal of the dispenser flap removes both the first tear tab and the second tear tab from the blank while leaving a portion of the first top gusset and second top gusset.

24. A carton blank, comprising:

a dispenser flap which forms a top panel of the blank, the dispenser flap being defined by at least one tear line;

a first side panel foldably connected to the top panel at a first fold line formed by the at least one tear line;

a second side panel foldably connected to the top panel at a second fold line formed by the at least one tear line;

at least one bottom flap foldably connected to at least one of the first and second side panels;

a first middle gusset adjacent to a first side of the top panel;

a second middle gusset adjacent to a second side of the top panel;

a first tuck-in gusset adjacent to a first side of the first side panel and foldably connected to the first middle gusset;

a first side gusset foldably connected to the first side of the first side panel and to the first tuck-in gusset, wherein the first side gusset is connected to the first side panel along a fold line that is not collinear with a cut line between the first tuck-in gusset and the first side panel;

a second tuck-in gusset adjacent to a first side of the second side panel and foldably connected to the first middle gusset; and a second side gusset foldably connected to the first side of the second side panel and to the second tuck-in gusset;

wherein the first side panel and the second side panel are configured to be folded perpendicularly to the top panel in an erected carton;

wherein the dispenser flap extends into the first top gusset to create a first tear tab and extends into the second top gusset to create a second tear tab;

wherein the dispenser flap is removable from the blank along the tear line;

wherein removal of the dispenser flap removes both the first tear tab and the second tear tab from the blank while leaving a portion of the first top gusset and second top gusset.

* * * * *